US005177962A

United States Patent [19]

Hall et al.

[11] Patent Number: 5,177,962

[45] Date of Patent: Jan. 12, 1993

[54] EXTERNAL SPARK ARRESTOR

[75] Inventors: Ronald L. Hall, Appleton; Oliver L. Greuel, New Holstein, both of Wis.

[73] Assignee: Tecumseh Products Company, Tecumseh, Mich.

[21] Appl. No.: 820,347

[22] Filed: Jan. 14, 1992

[51] Int. Cl.[5] ..... F01N 3/06

[52] U.S. Cl. ..... 60/311; 55/276; 55/385.1; 55/491; 55/DIG. 20; 181/231

[58] Field of Search ..... 60/311; 55/391, DIG. 30, 55/491, 385.1, 276; 181/231, 243

[56] References Cited

U.S. PATENT DOCUMENTS

| | | | |
|---|---|---|---|
| 2,463 | 2/1842 | Lewis | 55/317 |
| 63,411 | 4/1867 | Mehary | 55/307 |
| 82,003 | 8/1868 | Holton | 55/331 |
| 132,179 | 10/1872 | Radley | 55/331 |
| 459,179 | 9/1891 | Low | 55/328 |
| 1,096,035 | 5/1914 | Johnson | 55/DIG. 20 |
| 1,532,473 | 4/1925 | Byrne | 239/288 |
| 2,382,386 | 8/1945 | Arms | 60/311 |
| 2,524,588 | 10/1950 | Bechtel | 60/311 |
| 2,732,026 | 1/1956 | Folts | 181/231 |
| 2,782,868 | 2/1957 | Hopkins | 55/491 |
| 3,199,417 | 8/1965 | Young et al. | 55/491 |
| 3,406,501 | 10/1968 | Watkins | 60/311 |
| 3,677,364 | 7/1972 | Pawlina | 181/36 R |
| 3,881,250 | 5/1975 | Frederickson | 55/491 |
| 3,884,655 | 5/1975 | Coop | 55/276 |
| 4,453,618 | 6/1984 | Economaki | 184/105 B |
| 4,474,260 | 10/1984 | Valentine | 181/230 |
| 4,821,691 | 4/1989 | Veno et al. | 123/185.3 |

*Primary Examiner*—Ira S. Lazarus
*Assistant Examiner*—L. Heyman
*Attorney, Agent, or Firm*—Baker & Daniels

[57] ABSTRACT

An external spark arrestor assembly attached directly to the outer shell of a muffler of an internal combustion engine. The assembly includes a spark arresting screen disposed over the exhaust port of the muffler and forming a first exhaust-receiving conduit between the screen and the muffler; an outer perforated cover disposed over the screen and forming a second exhaust-receiving conduit between the screen and the outer cover; and a single centrally located fastener for removably fastening the screen and outer cover to the muffler shell.

10 Claims, 2 Drawing Sheets

EXTERNAL SPARK ARRESTOR

BACKGROUND OF THE INVENTION

The present invention relates generally to spark arrestors for small internal combustion engines, and more particularly, to a spark arrestor that is mounted external to the muffler.

Spark arrestors for preventing sparks from being discharged with exhaust gases from an internal combustion engine are well known in the art. Generally, spark arrestors are screen assemblies which filter the carbon from the combustion gases, thereby preventing the possible ignition of the carbon as the gases are exhausted from the muffler, which may result in a fire hazard. Spark arrestors may be internal, i.e., incorporated into the design of a muffler for an internal combustion engine, or external, i.e., mounted directly to an exhaust discharge pipe or to the discharge side of a muffler.

Internal spark arrestors add additional parts to a muffler assembly and may be difficult to clean if the muffler cannot be easily disassembled. Moreover, an internal spark arrestor incorporated into a muffler which cannot be disassembled may restrict the flow of exhaust gas, e.g,. from carbon build-up on the spark arrestor, and thereby cause excessive back pressure within the internal combustion engine. Thus, internal spark arrestors may cause inadequate engine performance after a period of use.

U.S. Pat. No. 3,677,364, issued to Pawlina illustrates an internal spark arrestor which may be used with an internal combustion engine. In the Pawlina patent, a spark arrestor is mounted within a muffler at the discharge end of the muffler, and an end cap having a plurality of exhaust holes is provided to protect the spark arrestor from physical damage. Such a spark arrestor may effectively arrest the discharge of sparks from an internal combustion engine. Notwithstanding this successful performance, efforts are continuously directed toward providing a more cost-efficient spark arrestor.

External spark arrestors of conventional design use a plurality of fasteners, e.g., screws or bolts, for attachment. The spark arresting screen is rigidly attached, usually by welding, to a metal ring adapted to be fastened to the muffler by a plurality of fasteners. The demand for such spark arrestors is not sufficient to allow automation of the associated manufacturing processes, and the cost of such spark arrestors tends to be relatively expensive because of the labor intensive construction process.

U.S. Pat. No. 1,532,473, issued to Byrne illustrates an externally mounted spark arrestor. The spark arrestor of Byrne is mounted directly to the end of an exhaust conduit of an internal combustion engine. The exhaust conduit is provided at the discharge end with an outwardly extending flange having two threaded mounting holes. A second flange is provided for receiving and allowing attachment of the spark arrestor screen to the flange of the exhaust conduit by two threaded bolts. Thus, the Byrne patent requires a plurality of fasteners to connect the spark arrestor to the exhaust conduit.

SUMMARY OF THE INVENTION

The present invention provides a spark arrestor assembly for attachment directly to the outer shell of a muffler, wherein the assembly includes a filter medium that is removably attached directly to the outer shell over the exhaust port of the muffler by a single fastener.

Generally, the present invention provides an internal combustion engine having a muffler with an exhaust port for the discharge of exhaust gases from the muffler. A spark arrestor assembly is attached directly to the exhaust port by a single fastener for filtering combustible materials such as carbon from the exhaust gases before the gases enter the atmosphere.

More particularly, the invention provides such a spark arrestor assembly having a generally cup-shaped spark-arresting screen and a generally cup-shaped perforated outer cover, wherein the screen and the cover are designed to form a nested assembly. Both the screen and the cover include a centrally located opening for receiving a fastener, such as a self-tapping, self-locking screw, which removably fastens the nested assembly directly to the muffler shell over the exhaust port.

An advantage of the spark arrestor assembly of the present invention is that the assembly may be easily disassembled by removing a single fastener for quick and convenient servicing or replacement of the filter screen.

Another advantage of the spark arrestor assembly of the present invention is that it is compact so that other components, such as a deflector or a heat shield, may be added.

Yet another advantage of the spark arrestor assembly of the present invention is that both the screen and the outer cover may be produced in a single stamping operation and without labor intensive secondary operations.

The present invention, in one form thereof, provides an internal combustion engine comprising an exhaust system including a muffler having an outer shell and an exhaust port for the discharge of exhaust gases from the muffler. A spark arresting filter is attached only to the outer shell for filtering the exhaust gases as they are discharged from the exhaust port. The filter is secured over the exhaust portion on the outer shell by a single fastener.

The present invention comprises, in one form thereof, a method of attaching a spark arrestor assembly to the outer shell of a muffler, wherein a spark arresting screen is placed directly over the exhaust port of a muffler. An outer perforated cover is placed over the screen to form a nested assembly, and a single fastener is inserted through the cover and the screen into the outer shell for removably securing the cover and the screen onto the outer shell.

DESCRIPTION OF THE PREFERRED EMBODIMENT

Figure 1:
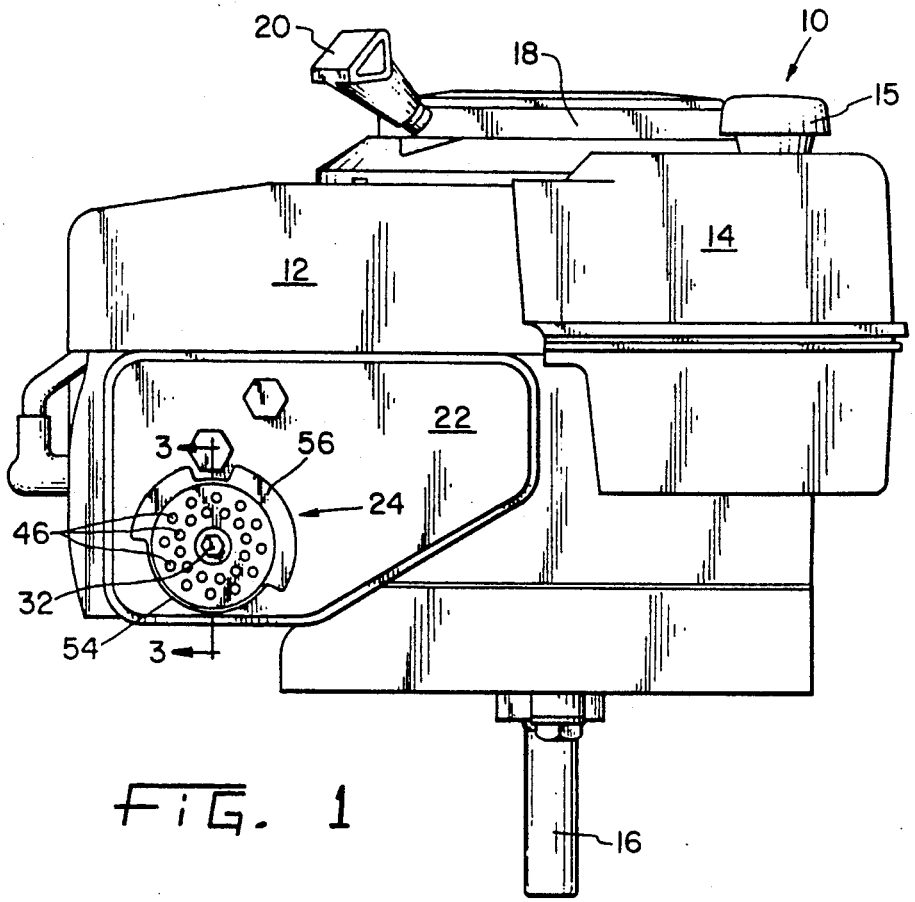
FIG. 1 is a front elevational view of a small internal combustion engine incorporating an external spark arrestor in accordance with the principles of the present invention.

Referring now to the drawings, and in particular to FIG. 1, there is shown a small internal combustion engine 10 of the vertical crankshaft variety as might be used to power a rotary lawn mower, for example. It is appreciated that the present invention may also be utilized in conjuction with horizontal crankshaft engines. Engine 10 includes a blower housing 12 and a fuel tank 14 including an oil fill cap 15. Engine crankshaft 16 is keyed to the flywheel (not shown) which includes air circulating blades or vanes (not shown) for air cooling of the engine. The flywheel is enclosed within blower housing 12. A manual recoil starting arrangement (not shown) is positioned above the flywheel and is enclosed within starter housing 18, which is preferably made of stamped steel. A pull start handle 20 extends from the top surface of starter housing 18. Engine 10 further includes an exhaust system including a muffler 22 having a plurality of openings 23 therein which define an exhaust port. The remaining components of engine 10 (e.g., carburetor, camshaft, piston, etc.) are well known and consequently are omitted for the sake of clarity in the following description.

Figure 2:
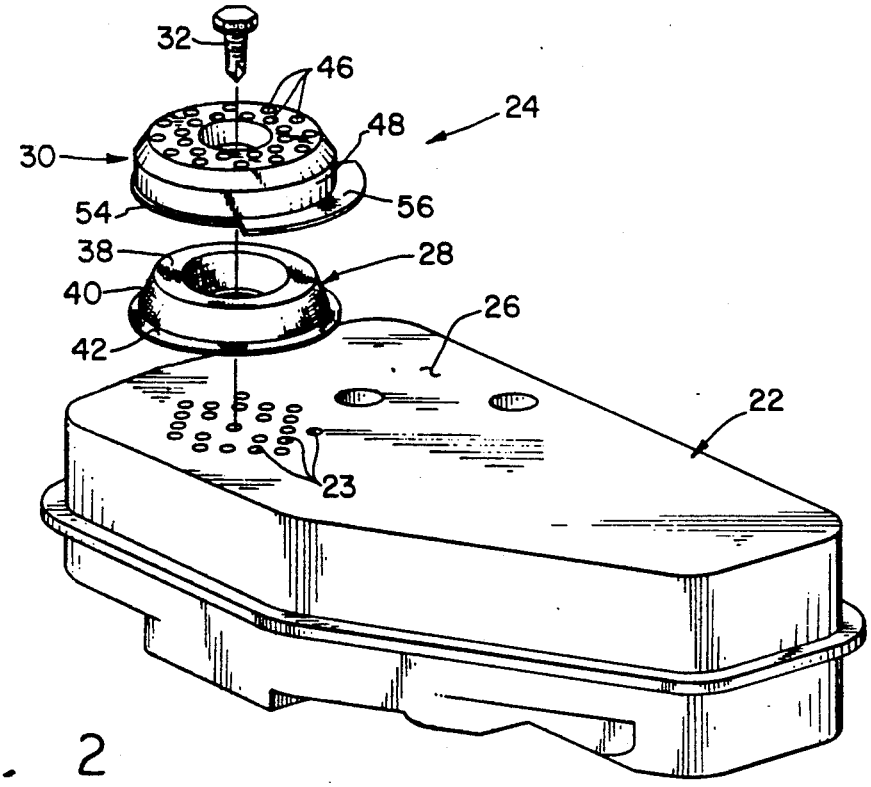
FIG. 2 is an enlarged perspective view of the muffler of FIG. 1, particularly showing an exploded view of the external spark arrestor.

In accordance with an embodiment of the present invention, there is shown in FIGS. 1 and 2, a spark arrestor assembly 24 which is externally mounted to outer shell 26 of muffler 22. More particularly, spark arrestor 24 includes a spark arresting screen 28, an outer cover 30 and a fastener 32. Screen 28 and cover 30 are generally cup-shaped, wherein screen 28 is adapted to fit within outer cover 30 to form a nested assembly as shown in FIG. 3.

Figure 3:
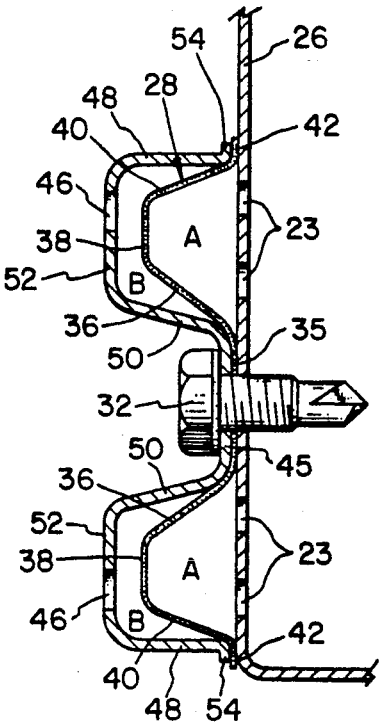
FIG. 3 is an enlarged sectional view of the assembled spark arrestor of FIG. 1, taken along line 3—3 in FIG. 1.
Figure 4:
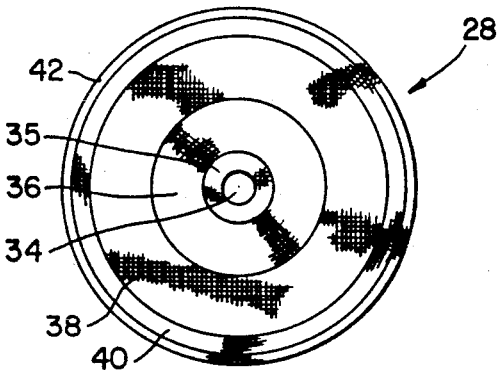
FIGS. 4 and 5 show top and side views, respectively of the spark arrestor screen.
Figure 5:
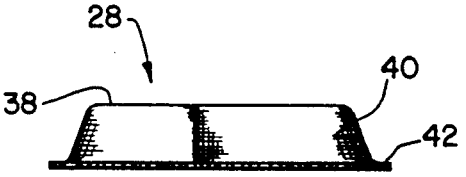

Referring to FIG. 3, screen 28 forms an annular exhaust-receiving chamber A that is disposed radially outwardly from fastener 32. As indicated above, screen 28 is formed to provide a maximum surface area for arresting sparks discharged by muffler 22. Moreover, screen 28 is preferably a resilient fine wire mesh with individual pore sized openings that effectively arrest sparks in the exhaust gas flowing from exhaust openings 23 of muffler 22. In a preferred embodiment, the individual pore sized openings of screen 28 are less than 0.000538 in.$^2$. An inexpensive stamping die may be used for forming the shape and trimming of the boundaries. Referring to FIGS. 2 and 4, screen 28 includes a centrally located opening 34 for receiving fastener 32, a flat inner portion 35 surrounding opening 34, a radially inwardly slanted portion 36, a generally annular raised portion 38, a radially outwardly slanted portion 40, and a peripheral lip 42. As shown in FIG. 3, portions 36, 38, and 40, form the boundaries of exhaust-receiving chamber A, which have generally U-shaped cross sections.

Figure 6:
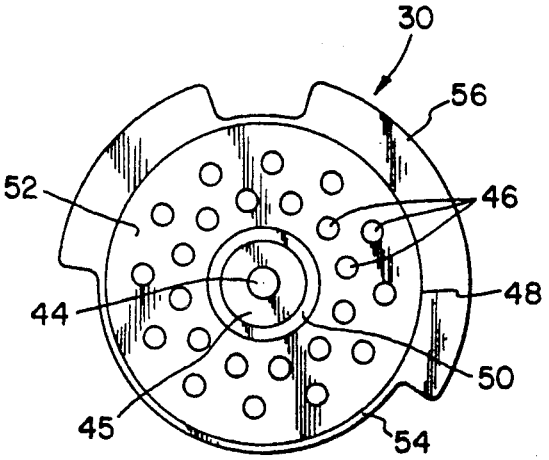
FIGS. 6 and 7 show top and side views, respectively, of the outer cover.
Figure 7:
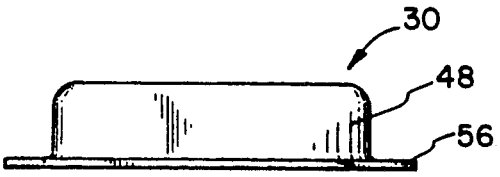

Referring to FIGS. 3 and 6–7, outer cover 30 is disposed over screen 28 and includes a centrally located opening 44 for receiving fastener 32, a flat inner portion 45 surrounding opening 44, a radially inward portion 50, an annular raised portion 52 having a plurality of exhaust discharge openings 46 therein for permitting the spark arrested exhaust gas discharge into the environment, a radially outward portion 48, and a peripheral lip 54. Outer cover 30 is formed to provide an exhaust-receiving chamber B (FIG. 3) for receiving spark arrested exhaust gases which pass through chamber A and spark arresting screen 28. Outer cover 30 further provides the dual functionality of protecting the spark arresting screen 28 from physical damage and ensuring contact of outwardly extending lip 42 of screen 28 with outer shell surface 26 of muffler 22 via pressure exerted by lip 54 of outer cover 30.

To provide intimate contact between spark arrestor screen 28 and outer shell 26 of muffler 22 when fastener 32 is fully seated, screen 28 and outer cover 30 may be formed to bias the outwardly extending lip 42 into contact with shell 26. For example, screen 28 and outer cover 30 may be formed such that prior to full seating of fastener 32, outwardly extending lip 42 of screen 28 is in intimate contact with muffler shell 26, but the portion of screen 28 disposed adjacent opening 34 is positioned a slight distance away from muffler shell 26. Likewise, outer cover 30 may be similarly formed. Thus, upon full seating of fastener 32, outwardly extending lips 42 and 54 of screen 28 and outer cover 30, respectively, would coact to provide a contact force against muffler shell 26 of muffler 22. Regarding outer cover 30, a preferred embodiment includes such a cover having discharge openings 46 which are ⅛ inch in diameter. It will be appreciated since the exact location and diameter of the exhaust gas discharge openings are not unique, various configurations may also be utilized.

Outwardly extending flange 56 may optionally be provided for receiving identification markings indicating the manufacturer of origin, type of spark arrestor, model number, or the like. Other embodiments wherein identification markings can be employed on radially outward portion 48 or annular raised portion 52 are also possible. Moreover, in the embodiment shown, radially inwardly extending portion 50 and outwardly extending portion 48 extend generally perpendicular to annular raised portion 52. However, portions 48 and 52 may be formed with, for example, radially inward portion 50 extending in an obtuse angle from raised portion 52, or having a chamfer at the discharge side of radially outward portion 48 (FIG. 2).

Although the embodiment of FIGS. 1–7 shows a screen 28 and a cover 30 which are generally cup-shaped, it may be appreciated by those skilled in the art that a screen and outer covering having a different geometric configuration are also within the scope of the present invention. For example, screen 28 and cover 30 could be rectangular in shape with a centrally located opening, as shown in FIG. 2, for receiving the fastener. Other geometric configurations could also be utilized. Moreover, depending on the size of spark arrestor 24, the openings in screen 28 and outer cover 30 for receiving fastener 20 may optionally be positioned at other than the central location of screen 28 and outer cover 30. For example, if the size of spark arrestor 24 is sufficiently small, these openings may be disposed at other than the geometric center of the spark arrestor and physical contact may still be maintained between screen 28 and outer shell 26 of muffler 22.

To effect attachment of spark arrestor 24 to muffler 22, screen 28 and cover 30 are placed in a nested position above exhaust openings 23 of muffler 22 such that spark arrestor 24 completely covers the plurality of exhaust openings 23. Fastener 32, which in a preferred embodiment comprises a self-tapping and self-locking screw, passes through the centrally located openings 34 and 44, respectively, of screen 28 and cover 30 and threadably engages one of the plurality of exhaust holes 23 to effect proper placement and attachment of spark arrestor 24 to muffler 22. As screw 32 is initially tightened, edge 54 of cover 30 engages edge 42 of screen 28. As screw 32 is further tightened, flat inner portion 45 of cover 30 engages flat portion 35 of screen 28 until screw 32 bottoms out against muffler shell 26. With screw 32 in a completely seated position (FIG. 3), screen 28 lies immediately adjacent outer shell 26 of muffler 22, and a tight seal is formed between peripheral portion 42 and shell 26 as well as between center portion 35 and shell 26 so that exhaust gases may not escape around peripheral edge 42. In order to remove spark arrestor 24 for servicing of filter screen 28, screw 32 is simply removed.

It will be appreciated that the foregoing is presented by way of illustration only, and not by way of any limitation, and that various alternatives and modifications may be made to the illustrated embodiment without departing from the spirit and scope of the invention.

What is claimed:

1. An internal combustion engine comprising:

an exhaust system including a muffler having an outer shell and an exhaust port for the discharge of exhaust gases from said muffler;

a spark arresting screen disposed over said exhaust port, said screen including an outer peripheral lip portion; and an outer perforated cover disposed over said spark arresting screen, said outer cover having a peripheral edge portion;

said screen and said cover being secured to said outer shell by a single fastener, said outer edge engaging and biasing said outer lip against said outer shell sufficiently to inhibit the discharge of exhaust gases between said outer shell and said lip portion.

2. The engine of claim 1, wherein said screen and said cover are each generally cup-shaped, said screen and said cover forming a nested assembly.

3. The engine of claim 1, wherein said screen forms a first exhaust-receiving chamber between said screen and said muffler, and said cover forms a second exhaust-receiving chamber between said screen and said cover.

4. The spark arrestor of claim 3, wherein said first and second exhaust receiving chambers are generally U-shaped in cross-section.

5. The engine of claim 1, wherein said outer cover is formed of a stamped metal.

6. The engine of claim 1, wherein said screen is stamped from a resilient wire mesh material.

7. The spark arrestor of claim 1, wherein said screen has a maximum individual pore size opening of 0.000538 inch.

8. The spark arrestor of claim 1, wherein said outer cover includes a flange formed at least partially around the periphery thereof.

9. The spark arrestor of claim 1, wherein said outer cover includes a peripheral flange for receiving identification markings to provide a visual indication of the specifications of said spark arrestor.

10. The spark arrestor of claim 1, wherein said fastener is a self-tapping and self-locking screw.

* * * * *